US007584655B2

(12) United States Patent
van Zuilekom et al.

(10) Patent No.: US 7,584,655 B2
(45) Date of Patent: Sep. 8, 2009

(54) FORMATION TESTER TOOL SEAL PAD

(75) Inventors: Anthony H. van Zuilekom, Houston, TX (US); Chi-Huang Michael Chang, Austin, TX (US); Sue-Lee Luo Chang, legal representative, Austin, TX (US); Arian Abbas, Houston, TX (US); Bruce W. Mackay, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/756,241

(22) Filed: May 31, 2007

(65) Prior Publication Data

US 2008/0295588 A1 Dec. 4, 2008

(51) Int. Cl.
*E21B 49/10* (2006.01)

(52) U.S. Cl. ..... 73/152.26; 166/100

(58) Field of Classification Search . 73/152.23–152.26, 73/152.02, 152.54, 152.55; 166/100, 264; 175/58, 59

See application file for complete search history.

(56) References Cited

U.S. PATENT DOCUMENTS 3,173,485 A * 3/1965 Bretzke, Jr. ..... 166/100
3,530,933 A * 9/1970 Whitten ..... 166/100
3,565,169 A * 2/1971 Bell ..... 166/100
3,653,436 A * 4/1972 Anderson et al. ..... 166/100
3,952,588 A * 4/1976 Whitten ..... 73/152.25
4,951,749 A * 8/1990 Carroll ..... 166/264
5,335,542 A * 8/1994 Ramakrishnan et al. .. 73/152.08
6,301,959 B1 10/2001 Hrametz et al.
6,585,045 B2 * 7/2003 Lee et al. ..... 166/252.5
6,658,930 B2 12/2003 Abbas
6,719,049 B2 * 4/2004 Sherwood et al. ..... 166/264
6,729,399 B2 * 5/2004 Follini et al. ..... 166/264
7,114,385 B2 * 10/2006 Fisseler et al. ..... 73/152.26
7,121,338 B2 10/2006 van Zuilekom et al.
7,152,466 B2 * 12/2006 Ramakrishnan et al. .. 73/152.51
7,395,879 B2 * 7/2008 Segura et al. ..... 175/50
7,416,023 B2 * 8/2008 Krueger et al. ..... 166/250.01
2003/0145652 A1 * 8/2003 Arian ..... 73/152.26
2003/0173115 A1 * 9/2003 Krueger et al. ..... 175/59
2004/0173351 A1 * 9/2004 Fox et al. ..... 166/264
2005/0011644 A1 * 1/2005 Krueger et al. ..... 166/250.07
2005/0161218 A1 * 7/2005 van Zuilekom et al. ..... 166/264
2006/0075813 A1 * 4/2006 Fisseler et al. ..... 73/152.26
2007/0181341 A1 * 8/2007 Segura et al. ..... 175/50

* cited by examiner

*Primary Examiner*—John Fitzgerald
(74) *Attorney, Agent, or Firm*—Schwegman, Lundberg & Woessner, P.A.

(57) ABSTRACT

A formation tester tool includes a formation tester tool body having a surface, a formation probe assembly located within the formation tester tool body, the formation probe assembly including a piston reciprocal between a retracted position and an extended position beyond the surface of the formation tester tool body, the piston being slidingly retained within a chamber, and a seal pad located at an end of the piston, wherein the seal pad includes a first inner sealing element and a second outer sealing element.

20 Claims, 15 Drawing Sheets

FORMATION TESTER TOOL SEAL PAD

STATEMENT REGARDING FEDERALLY SPONSORED RESEARCH OR DEVELOPMENT

Not applicable.

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation temperature, formation pressure, bubblepoint and formation pressure gradient. These tests are performed in order to determine whether commercial exploitation of the intersected formations is viable and how to optimize production.

Wireline formation testers (WFT) and drill stem testing (DST) have been commonly used to perform these tests. The basic DST test tool consists of a packer or packers, valves or ports that may be opened and closed from the surface, and two or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart static pressures. A sampling chamber traps clean formation fluids at the end of the test. WFTs generally employ the same testing techniques but use a wireline to lower the test tool into the well bore after the drill string has been retrieved from the well bore, although WFT technology is sometimes deployed on a pipe string. The wireline tool typically uses one or more packers also, although the packer/packers are placed closer together, compared to drill pipe conveyed testers, for more efficient formation testing. In some cases, packers are not used. In those instances, the testing tool is brought into contact with the intersected formation and testing is done without zonal isolation.

WFTs may also include a probe assembly for engaging the borehole wall and acquiring formation fluid samples. The probe assembly may include an isolation pad to engage the borehole wall. The isolation pad seals against the formation and around a hollow probe, which places an internal cavity in fluid communication with the formation. This creates a fluid pathway that allows formation fluid to flow between the formation and the formation tester while isolated from the borehole fluid.

Another testing apparatus is a measurement while drilling (MWD) or logging while drilling (LWD) tester. Typical LWD/MWD formation testing equipment is suitable for integration with a drill string during drilling operations. Various devices or systems are provided for isolating a formation from the remainder of the wellbore, drawing fluid from the formation, and measuring physical properties of the fluid and the formation. With LWD/MWD testers, the testing equipment is subject to harsh conditions in the wellbore during the drilling process that can damage and degrade the formation testing equipment before and during the testing process. These harsh conditions include vibration and torque from the drill bit, exposure to drilling mud, drilled cuttings, and formation fluids, hydraulic forces of the circulating drilling mud, and scraping of the formation testing equipment against the sides of the wellbore. Sensitive electronics and sensors must be robust enough to withstand the pressures and temperatures, and especially the extreme vibration and shock conditions of the drilling environment, yet maintain accuracy, repeatability, and reliability.

In order to acquire a useful sample, the probe must stay isolated from the relative high pressure of the borehole fluid. Therefore, the integrity of the seal that is formed by the seal pad is important to the performance of the tool. If the borehole fluid is allowed to leak into the collected formation fluids, a non-representative sample will be obtained and the test will have to be repeated. The reliability and ability for seal pads or isolation probes to seal and isolate becomes increasingly more difficult when the borehole temperature rises due to the materials used in the seal pad to form or maintain a seal between the pad and formation or borehole.

What is needed is a seal pad designed for the hostile conditions that is able to maintain a seal or isolation in these conditions, and that provides reliable sealing performance with an increased durability and resistance to damage.

BRIEF DESCRIPTION OF THE DRAWINGS

For a more detailed description of preferred embodiments of the present invention, reference will now be made to the accompanying drawings, wherein.

DETAILED DESCRIPTION

Figure 1:
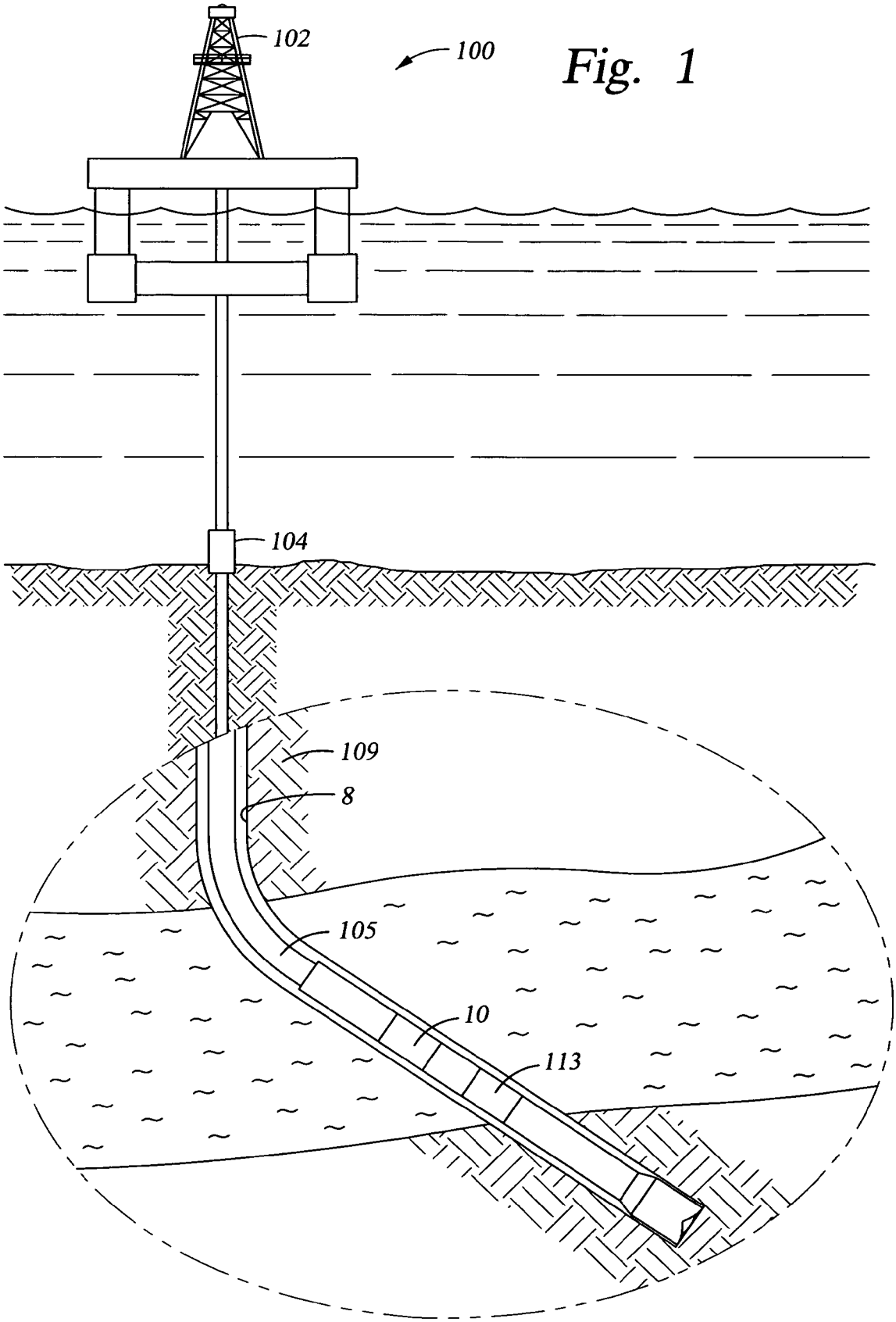
FIG. 1 is a schematic view of an embodiment of a system including a formation tester tool disposed in a subterranean well.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the terms "couple," "couples", and "coupled" used to describe any mechanical or electrical connections are each intended to mean and refer to either an indirect or a direct mechanical or electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the borehole and "down" meaning towards the bottom or distal end of the borehole. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

FIG. 1 illustrates a system 100 for drilling operations. The system 100 includes a drilling rig 102 located at a surface 104 of a well. The drilling rig 102 provides support for a drill string 105. The drill string 105 penetrates a rotary table for drilling a borehole 8 through subsurface formations 109. A downhole tool 113 may be any of a number of different types of tools including measurement-while-drilling ("MWD") tools, logging-while-drilling ("LWD") tools, etc. It should be noted the system 100 can be used with a wireline tool as well.

The downhole tool 113 includes, in various embodiments, one or a number of different downhole sensors, which monitor different downhole parameters and generate data that is stored within one or more different storage mediums within the downhole tool 113. The downhole tool 113 can include a power source, such as a battery or generator. A generator could be powered either hydraulically or by the rotary power of the drill string. The generator could also be on the surface and the power supplied through conductor or conductors in a wireline or drillpipe.

The downhole tool 113 includes a downhole sampling device such as a formation tester tool 10, which can be powered by the power source. In one embodiment, the formation tester tool 10 may be mounted on a drill collar or wireline deployed. Thus, even though formation tester 10 is shown as part of drill string 105, the embodiments of the invention described below may be conveyed down borehole 8 via any drill string or wireline technology, as is partially described above and is well known to one skilled in the art.

Figure 2:
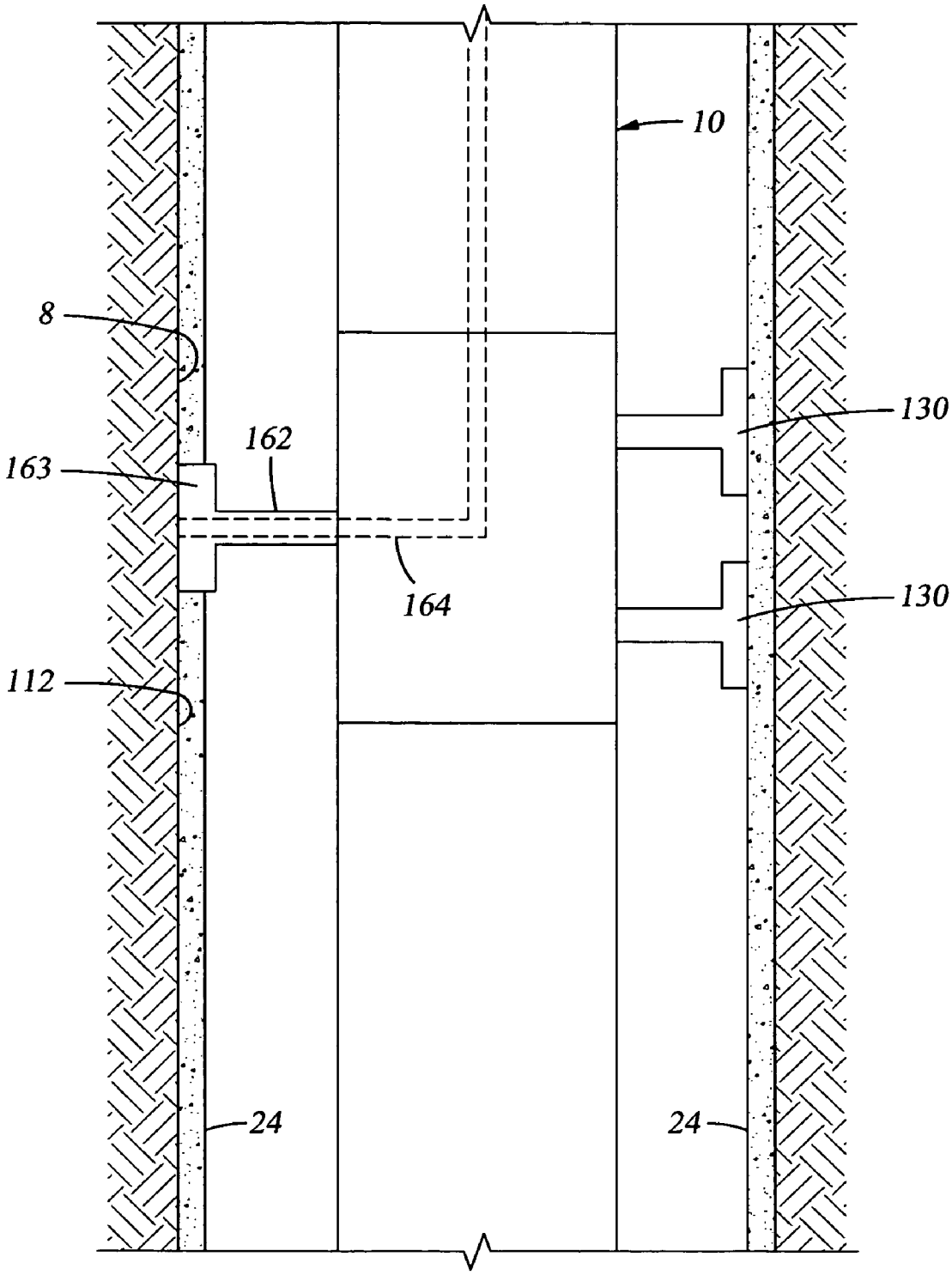
FIG. 2 is a schematic view of a formation tester tool disposed in a well.

FIG. 2 schematically illustrates the formation tester tool 10 in position to retrieve subterranean formation fluid from the borehole 8, in accordance with one embodiment. The formation tester tool 10 includes a probe 162 and a seal pad 163 that contacts the wall 112 of the borehole 8 through mud cake 24 isolating the borehole and seals out mud flowing in the bore. In one option, the probe 162 includes a snorkel that extends into the formation to obtain formation fluid. The snorkel is, in an embodiment, is fluidly connected to a main sampling flowline 164. The formation tester tool 10 optionally further includes one or more extendible backup pistons 130.

Figure 3:
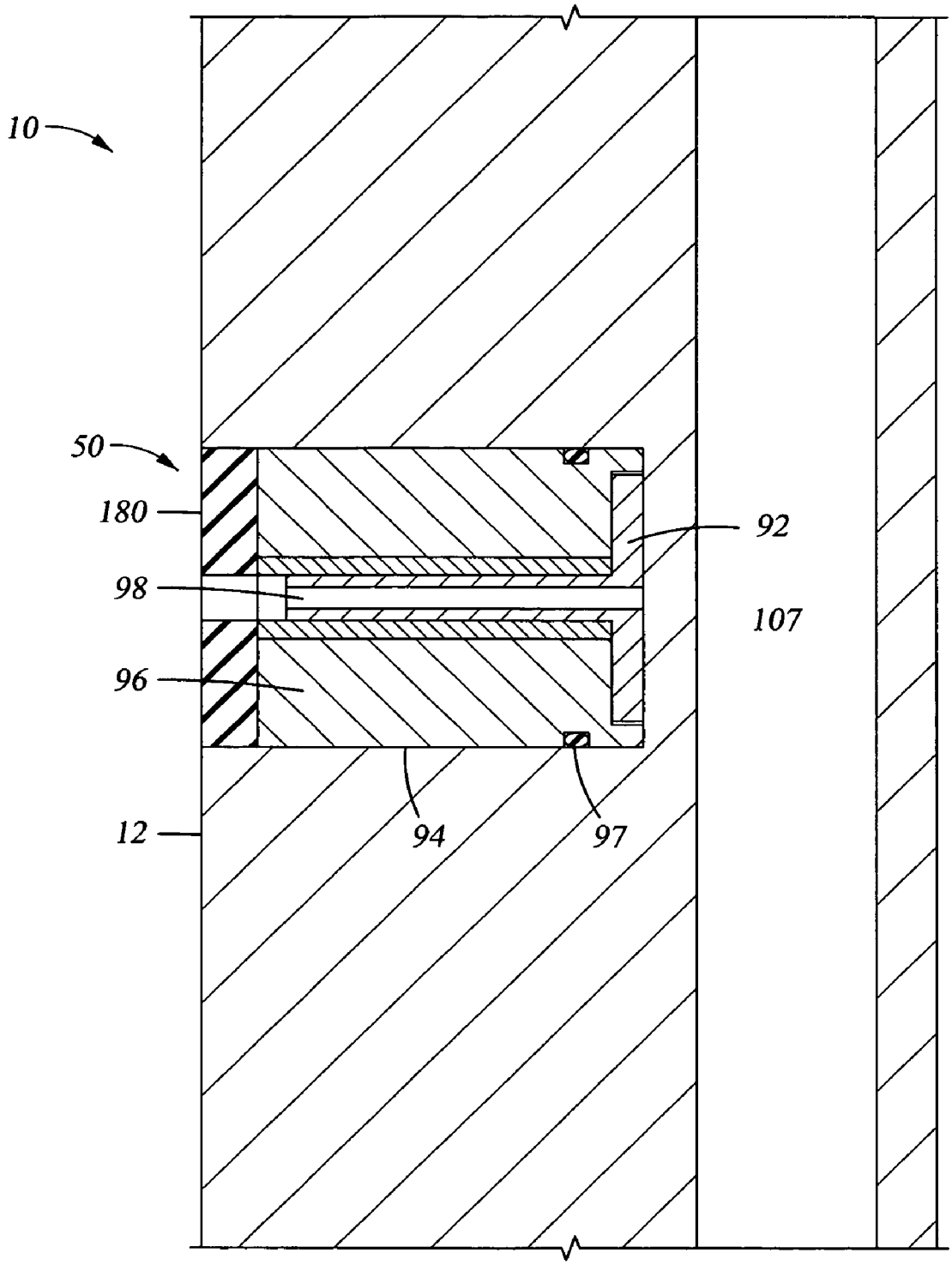
FIG. 3 is section view of a probe assembly in a retracted position, in accordance with one embodiment.
Figure 4:
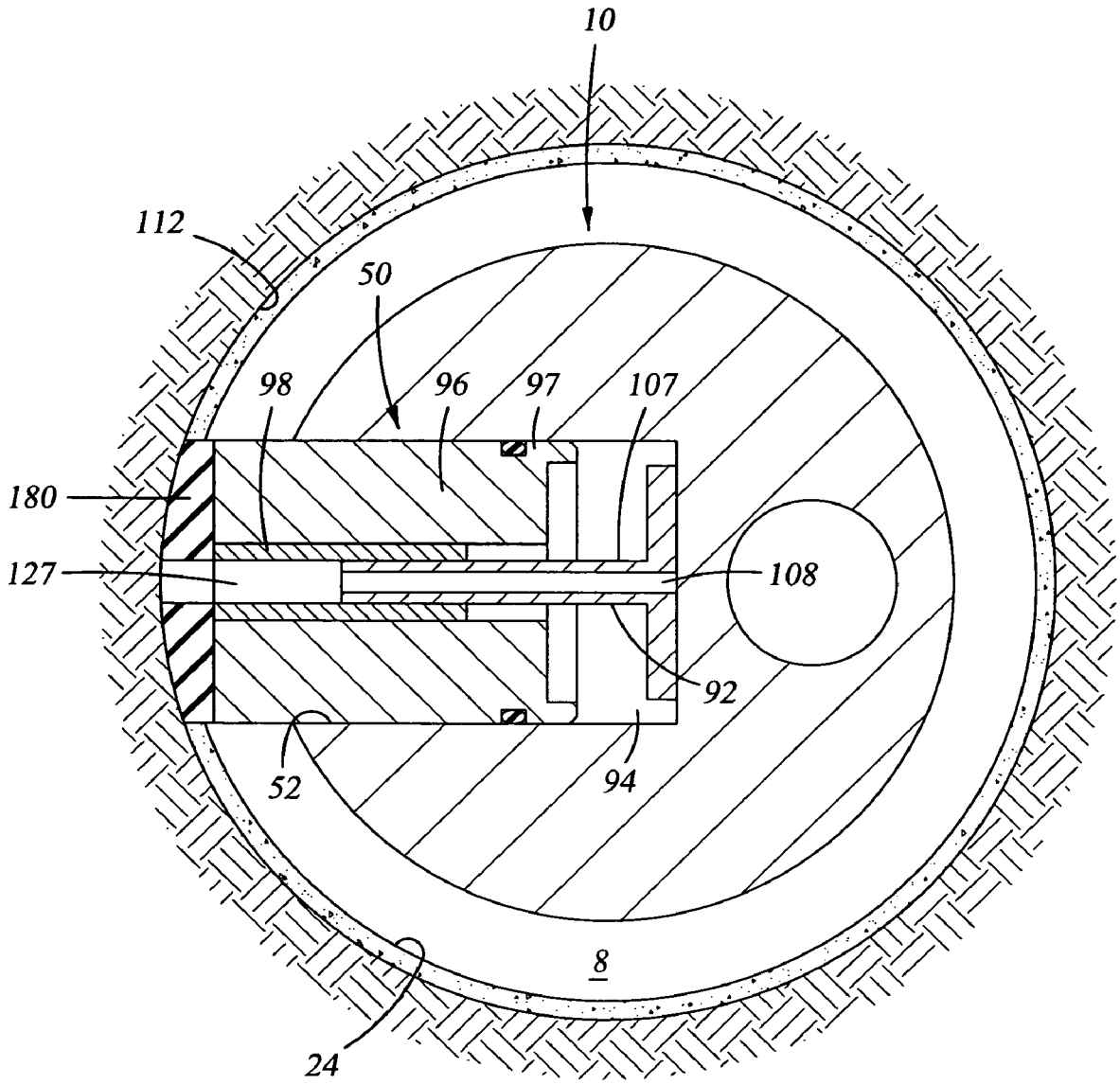
FIG. 4 is section view of a probe assembly in an extended position, in accordance with one embodiment.

FIGS. 3 and 4 show a schematic representation of a probe assembly 50 for formation tester tool 10, in accordance with one embodiment. FIG. 3 is side, section view of the probe assembly 50 in a retracted position, and FIG. 4 is top, section view of the probe assembly 50 in an extended position. Also, in FIG. 4 formation tester tool 10 is shown disposed in a borehole 8 drilled into a formation. The wall 112 of borehole 8 is coated with mud cake 24 that is formed by the circulation of wellbore fluid through the wellbore.

Formation tester tool 10 has a substantially cylindrical body that is typical of tools used in downhole environments. Formation tester tool 10 includes hydraulic conduits and sample conduits therethrough. For example, a sample conduit can be in fluid communication with a drawdown chamber whose volume can be varied by actuating one or more drawdown pistons, such as are known in the art.

Formation probe assembly 50 generally includes stem a 92, a piston chamber 94, a piston 96 adapted to reciprocate within piston chamber 94, a snorkel 98 adapted for reciprocal movement within piston 96, and a seal pad 180 located at an end of piston 96. Snorkel 98 includes a central passageway 127. Formation probe assembly 50 is configured such that piston 96 extends and retracts through aperture 52 of the formation tester tool 10. Stem 92 includes a tubular extension 107 having central passageway 108. Central passageway 108 is in fluid connection with fluid passageways leading to other portions of tester tool 10, including a drawn down assembly, for example. Thus, a fluid passageway is formed from the formation through snorkel passageway 127 and central passageway 108 to the other parts of the tool.

Formation probe assembly 50 is assembled such that piston 96 includes shoulders 97 to allow hydraulic pressure to be used to extend and retract the piston. In use, snorkel 98 further extends into the formation wall to communicate with the formation fluid. Probe assembly 50 is extended by applying fluid pressure through hydraulic conduits so that hydraulic pressure is applied to shoulder 97. The pressure advances piston 96 and seal pad 180 toward the wall of the wellbore.

Seal pad 180 seals and prevents drilling fluid or other contaminants from entering the probe assembly 50 during formation testing. Typically, the pressure of the formation fluid is less than the pressure of the drilling fluids that are injected into the borehole. A layer of residue from the drilling fluid forms mud cake 24 on the borehole wall and separates the two pressure areas. Pad 180, when extended, contacts the borehole wall and, together with the mud cake, forms a seal.

In order to acquire a useful sample, probe assembly 50 should stay isolated from the relative high pressure of wellbore fluid. Therefore, the integrity of the seal that is formed by seal pad 180 is important to the performance of the tool. If wellbore fluid is allowed to leak into the collected formation fluids, a non-representative sample will be obtained and the test will have to be repeated.

Figure 5A:
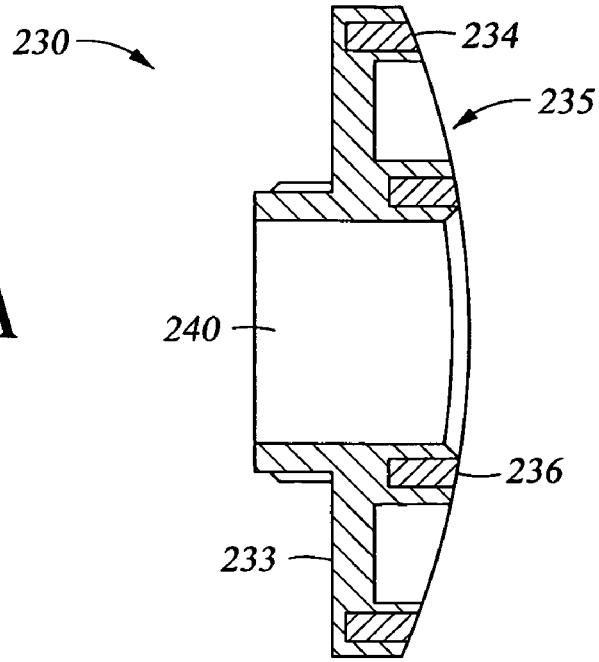
FIG. 5A shows a top cross-section view of a seal pad, in accordance with one embodiment.
Figure 5B:
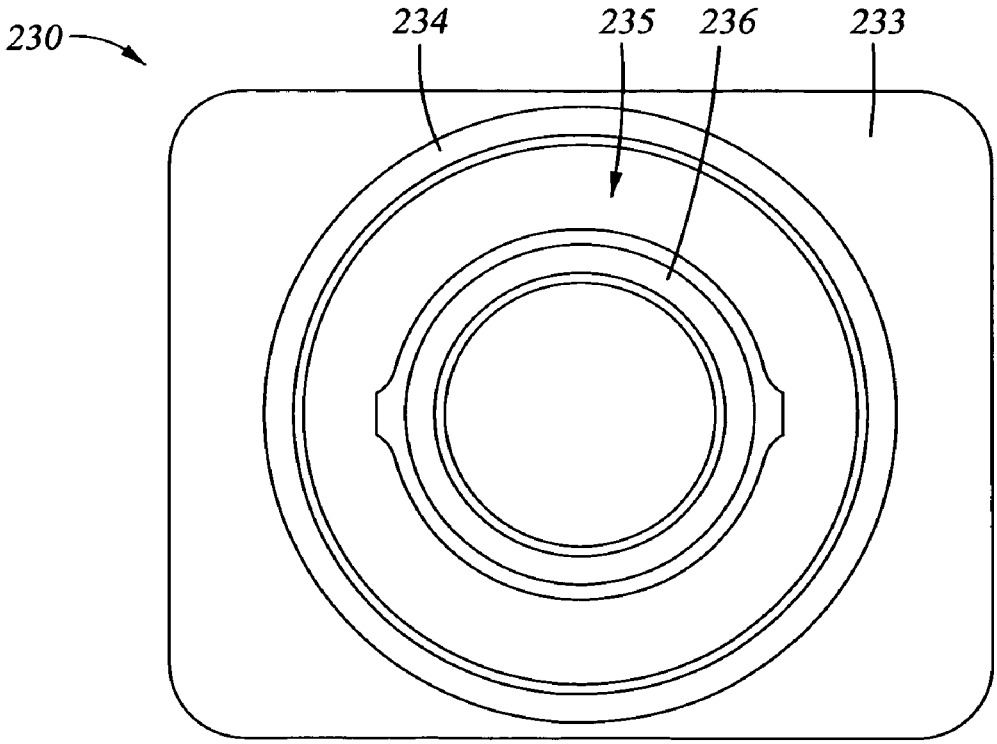
FIG. 5B shows a front view of the seal pad of FIG. 5A.

FIGS. 5A and 5B show a seal pad 230, in accordance with one embodiment. Seal pad 230 includes a plate or fixture 233 suitable to be attached to the testing tools discussed above and represented by pad 163 in FIG. 2 or seal pad 180 of FIGS. 3 and 4. Seal pad 230 generally includes a first outer sealing element 234 and a second inner sealing element 236 arranged in concentric manner on plate 233 such that a space 235 is formed therebetween. Seal pad 230 includes a port 240 for formation fluid to enter the testing tool assembly. When the seal pad 230 is set against the formation wall 112 (FIG. 2) so that the elements 234 and 236 come into contact with the mud cake 24 and/or the formation wall 112 or a close proximity to it depending on the amount of trapped mud cake 24. Additional force may be applied to the plate 233 with hydraulic and/or mechanical force backing up tool 10 with back up pistons 130; the amount of force will vary depending on the downhole conditions but will be greater than 1 psi.

The elements 234 and 236 may include but are not limited to rubber products, HNBR, Teflon, peak, metal, alloys and/or combination thereof. The elements 234 and 236 may be supported and/or energized by additional materials behind the elements so to enable them to adjust the shape of the borehole and/or retract into the pad 230 depending on the force applied. In most cases mud cake 24 is present and the mud cake 24 and/or borehole fluid may be captured and trapped in the slot or space 235 as the pad is deployed from tool 10 and the mud cake is fully or partially sealed in place by elements 234 and 236 so to form a compressed liquid barrier between elements 234 and 236. The compression and compaction of the trapped mud cake 24 and borehole fluid in the slot or space 235 will depend on the thickness and compressibility of the mud cake between the pad and the formation wall 112 and the size and shape of the elements 234 and 236. FIG. 5 shows a single slot 235 but pad may consist of more that one slot 235 between elements 234 and 236 and/or any number of elements or slots to form a seal and/or isolation using trapped mud cake 24 and/or the formation fluid.

After being set, formation fluid can be drawn into one or more flowlines 164 (FIG. 2) through port or ports 240 which may contain a probe or snorkel. During the flow of formation fluid into flowline/flowlines 164 through port/ports 240 a drawdown of the pressure may take place. During this drawdown there may be a pressure differential between space 235 and inlet port 240, this differential may cause the trapped mud to release filtrate from the fluid in slot 235 across element 236, this may the form additional mud cake across the face of the element 236. (Mud is generally made up from liquid and solid and when the liquid is separated from the solids we call the liquid filtrate and the solids left behind mud cake.) Additionally any loss of volume from slot 235 may cause a flow of filtrate across element 234 casing a barrier of mud cake to form on the end of element 234. Build up of mud cake in addition to the trapped mud cake may supply additional seal to the pad between the borehole 8 and the formation flow port 240.

Figure 6:
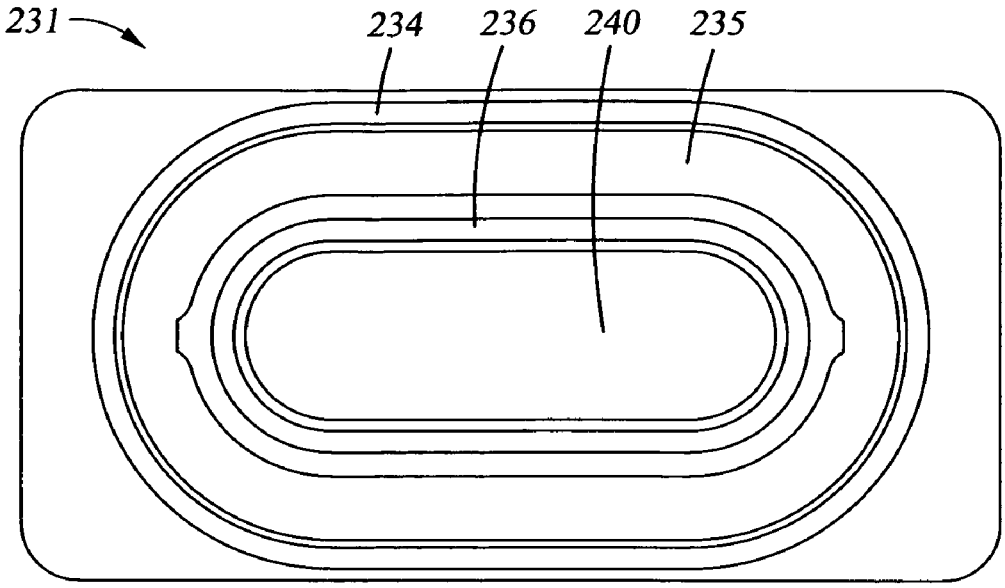
FIG. 6 shows a front view of a seal pad, in accordance with one embodiment.

FIG. 6 shows a front view of a seal pad 231, in accordance with one embodiment. Seal pad 231 includes a similar configuration as seal pad 230 discussed above. In this embodiment, seal pad 231 includes an oblong or oval shape, with sealing elements 234, 236 and space 235 all having a generally oblong or oval shape.

Figure 7:
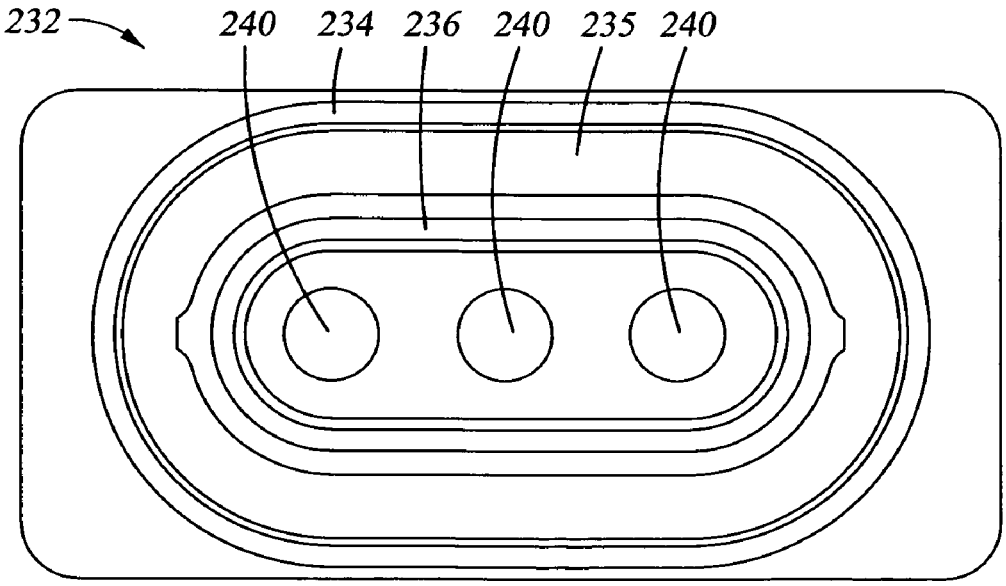
FIG. 7 shows a front view of a seal pad, in accordance with one embodiment.

FIG. 7 shows a front view of a seal pad 232, in accordance with one embodiment. Seal pad 231 includes a similar configuration as seal pad 230 discussed above. In this embodiment, seal pad 231 includes three ports 240. Other embodiments can include fewer or more ports.

Figure 8A:
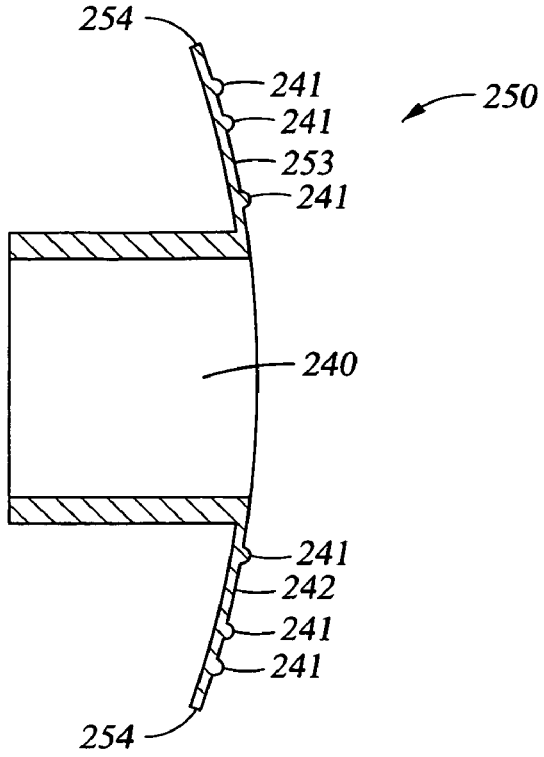
FIG. 8A shows a top cross-section view of a seal pad, in accordance with one embodiment.
Figure 8B:
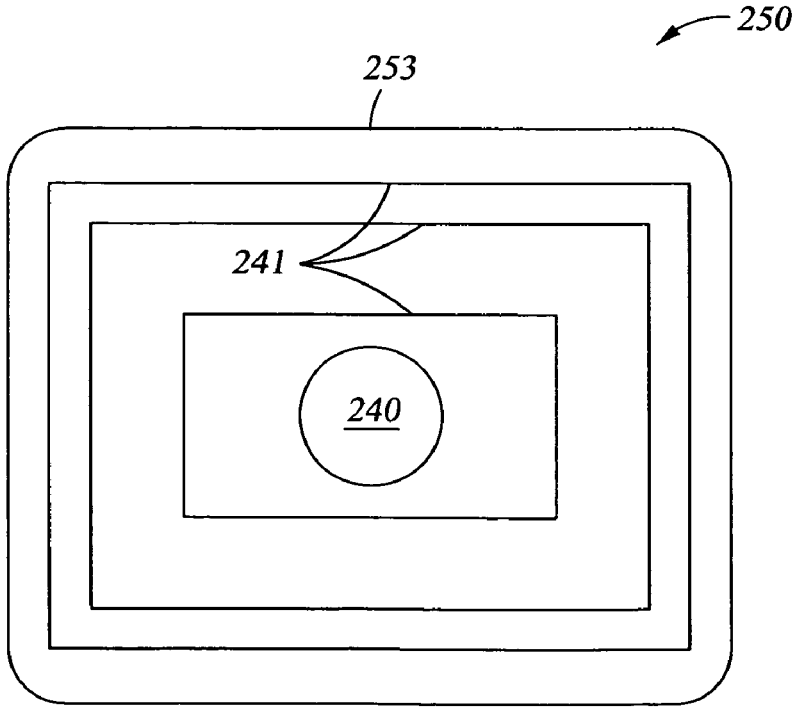
FIG. 8B shows a front view of the seal pad of FIG. 8A.

FIGS. 8A and 8B show a seal pad 250, in accordance with one embodiment. Seal pad 250 includes a plate 253 and a flexible metallic pad 242 with one or more sealing rings 241 arranged to form sealing elements. Seal pad 250 can be used on the testing tools discussed above and represented by pad 163 in FIG. 2 or seal pad 180 of FIGS. 3 and 4. The surface of the pad 242 in the area of the rings 241 may be flexible and of a radius greater than the borehole so to promote the outer edge 254 of pad 242 to come into contact first when the plate 253 is deployed from assembly 50 (FIG. 3).

As the plate 253 is deployed and compressed into the formation wall 112 (FIG. 2), the metallic surface of pad 242 flexes and conforms to the shape of the borehole wall 112 trapping or compressing mud cake 24 between sealing members 241, this may provide the initial seal against the borehole fluid once the pad 232 makes contact with the formation wall 112.

When extended, the metallic pad 242 pushes into the mudcake 24 and/or formation wall 112 it may form a primary seal and it may also trap the mud cake 24 between the sealing elements 241 for a secondary sealing system.

The raised rings 241 of material on the surface of the metal pad 242 may also be embedded into the formation wall 112 forming a seal or isolation. With the primary and secondary seals energized, a fluid sample can be collected from the formation wall 112; formation fluid may now be drawn into the flowline 164 through port 240 which may contain a probe or snorkel.

In one embodiment, the metallic pad 242 includes a smooth surface. The pad 242 in the outer edge 254 may be flexible and of a radius greater than the borehole so to promote the outer edge 254 of pad 242 to come into contact first when the plate 233 is deployed from assembly 50 (FIG. 3). The flexible pad 242 may form to the shape of the borehole as it is pushed into the mudcake 24 and/or formation wall 112 it may form a primary seal, the seal may be formed by a combination of the surface of the pad 242 and the formation wall 112 and/or the compaction of the mud cake 24 into and voids between the mud cake 24 and the formation wall 112. The smooth surface may allow for creation of suction and hence better sealing against the borehole wall 112.

In one embodiment the metallic pad 242 has a coated surface, and the coating may consist but not limited to rubber products, HNBR, Teflon, peak, metal, alloys or and combination and be bonded, glued or attached in any manner to allow for the metallic pad to flex. The pad 242 in the outer edge may be flexible and of a radius greater than the borehole so to promote the outer edge of pad 242 to come into contact first when the plate 233 is deployed from assembly 50 (FIG. 3). The flexible pad 242 may form to the shape of the borehole as it is pushes into the mudcake 24 and/or formation wall 112 it may form a primary seal, the seal may be formed by a combination of the coated surface of the pad 242 and the formation wall 112 and/or the compaction of the mud cake 24 into and voids between the mud cake 24 and the formation wall 112. The coated surface and the flexible nature of the pad 242 may allow for creation of sealing against the borehole wall 112.

Figure 9:
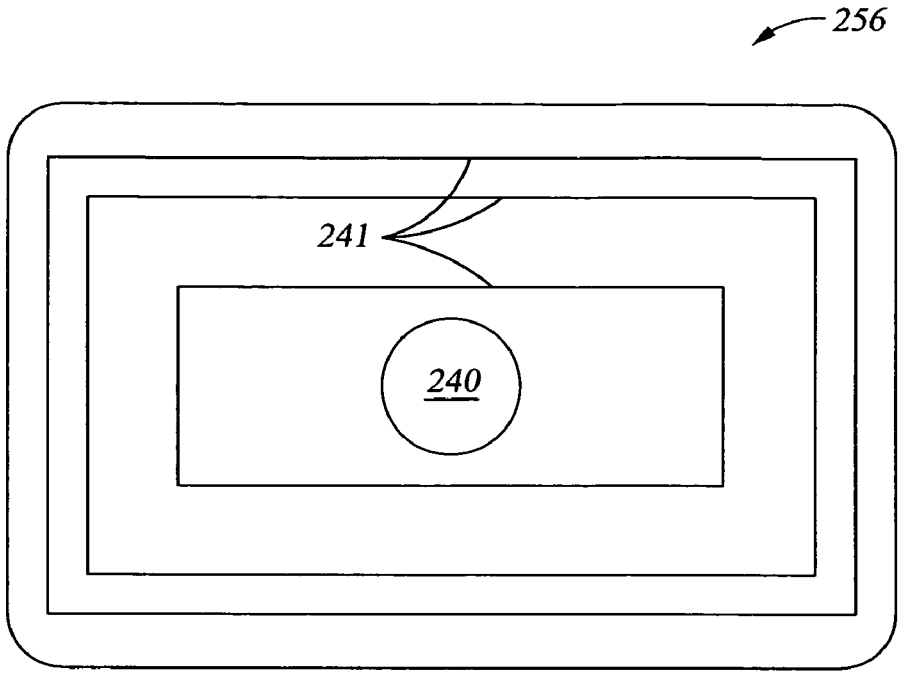
FIG. 9 shows a front view of a seal pad, in accordance with one embodiment.

FIG. 9 shows a front view of a seal pad 256, in accordance with one embodiment. Seal pad 256 includes a similar configuration as seal pad 250 discussed above. In this embodiment, seal pad 256 includes a more oblong or oval shape.

Figure 10:
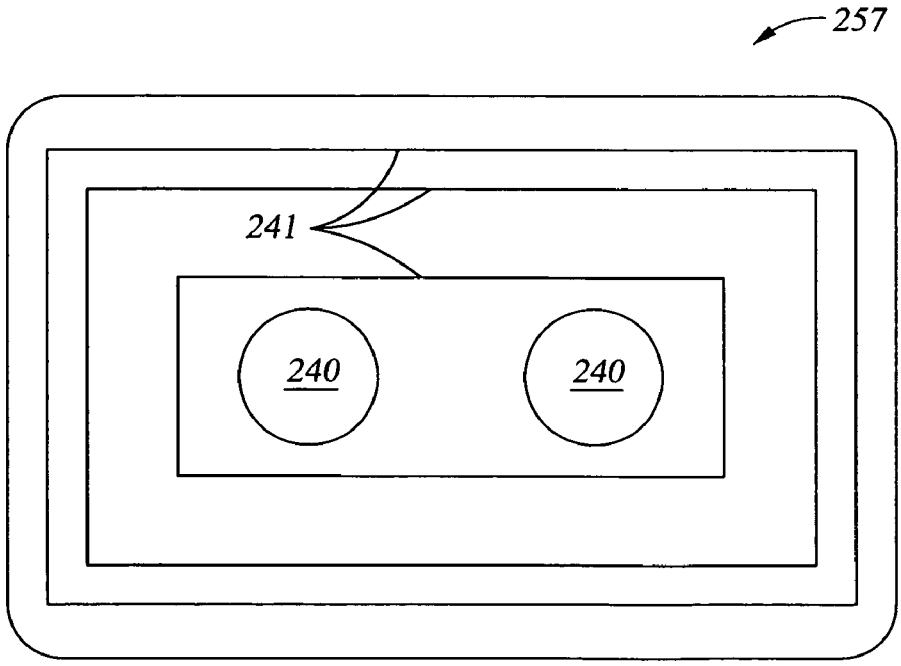
FIG. 10 shows a front view of a seal pad, in accordance with one embodiment.

FIG. 10 shows a front view of a seal pad 257, in accordance with one embodiment. Seal pad 257 includes a similar configuration as seal pad 250 discussed above. In this embodiment, seal pad 257 includes two ports 240. Other embodiments utilize different numbers of ports.

Figure 11:
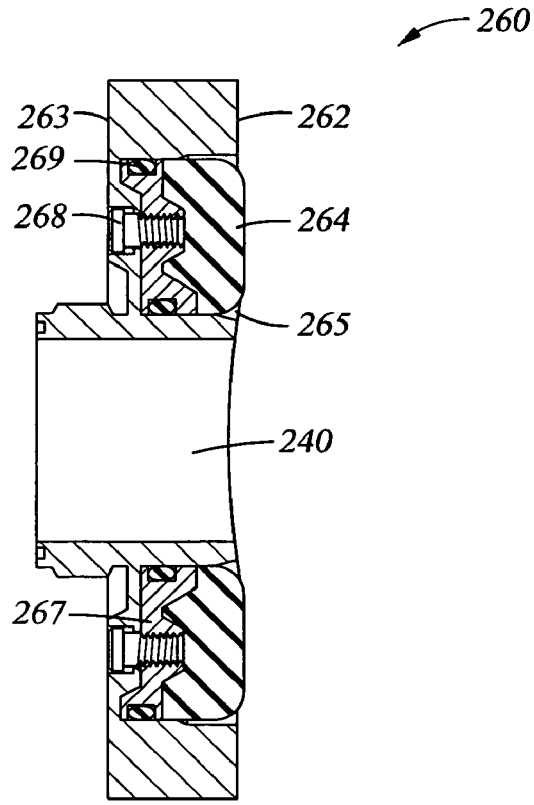
FIG. 11 shows a top cross-section view of a seal pad, in accordance with one embodiment.
Figure 12:
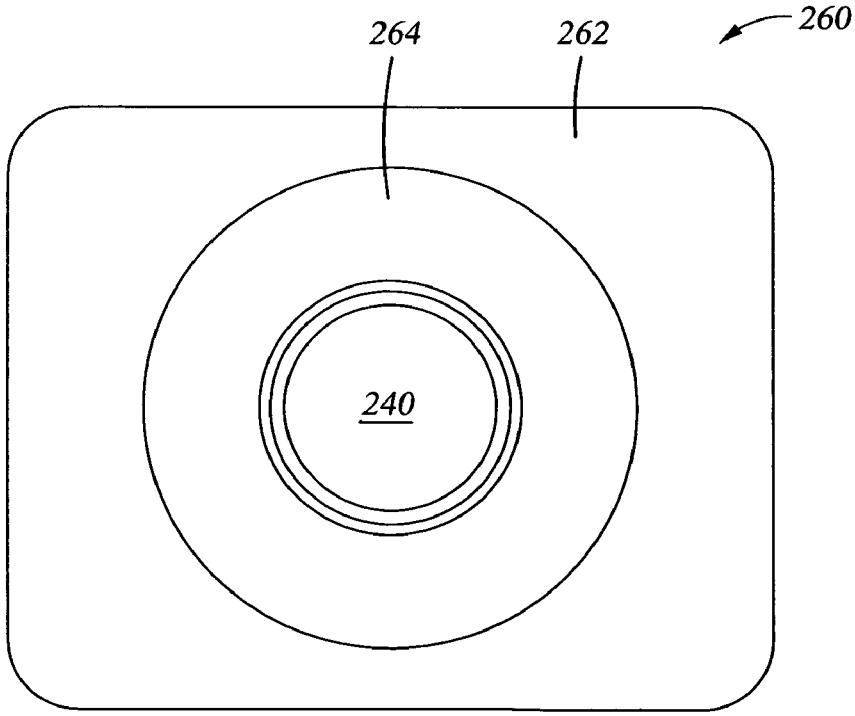
FIG. 12 shows a front view of the seal pad of FIG. 11.

FIGS. 11 and 12 show a seal pad 260, in accordance with one embodiment. Seal pad 260 includes a piston pad that includes a plate or fixture 263 suitable to be attached to the testing tool and represented by pad 163 in FIG. 2 or pad 180 in FIGS. 3 and 4. The seal pad 260 generally includes a first sealing element such as pad edge 262 and a second sealing element, such as pad edge 263. Pad 260 and edges 263 and 262 can be formed of metal. The pad 260 also includes a movable piston 267 having at least one seal 269 between plate 263 which may have sealing element 264 attached. Sealing element 264 can include but not limited to rubber products, HNBR, Teflon, peak, metal, alloys or and combination. Piston 267 may also have a retainer 268 to limit the extent at with the piston 267 can move forward or to keep it attached to plate 263. Movable sealing element 264 is located in the space 265 between edges 263 and 262.

The pad 260 is set against the formation wall 112 (FIG. 2) so that the pad edge 262 and/or 263 come into contact with the mud cake 24 and/or the formation wall 112 or a close proximity to it depending on the amount of trapped mud cake 24. Additional force may be applied to the plate 263 with hydraulic and/or mechanical force backing up tool 10 (FIG. 2) with back up pistons 130; the amount of force will vary depending on the downhole conditions but will be greater than 1 psi.

Pad edge 262 and/or 263 may be coated with materials and/or shaped to promote a seal between the formation wall 112 and the borehole fluid. Pad edges 262 and/or 263 may employ other embodiments discussed in this disclosure to form a seal.

Formation fluid may now be drawn into the flowline through port 240 which may contain a probe or snorkel. During the flow of formation fluid into the tool flowline through port 240, a drawdown of the pressure may take place. During the drawdown there may be a pressure differential between the borehole fluid representing the fluid behind plate 263 and inlet port 240 which may be maintained by the seal formed by pad edges 263 and/or 262.

There may be a differential pressure across piston 267 if there is any fluid communication between flow path port 240 and the slot or space 265 containing sealing element 264 between pad edge 262 and 263. This differential pressure may cause the piston 267 to move forward due to the pressure isolation provided by seal 269 which may exert force equal to the differential pressure across the area of piston 267 between the sealing element 264 and formation wall 112 and/or the mud cake 24. The greater the differential pressure across piston 267 the greater the force is applied to sealing element 264 improving the seal between the borehole and the desired flow of fluid into the flowline 164 through flowpath 240. The inner edge of surface of edge 263 adjacent to sealing element 264 may be shaped to support the sealing element 264 to reduce extrusion damage.

Figure 13:
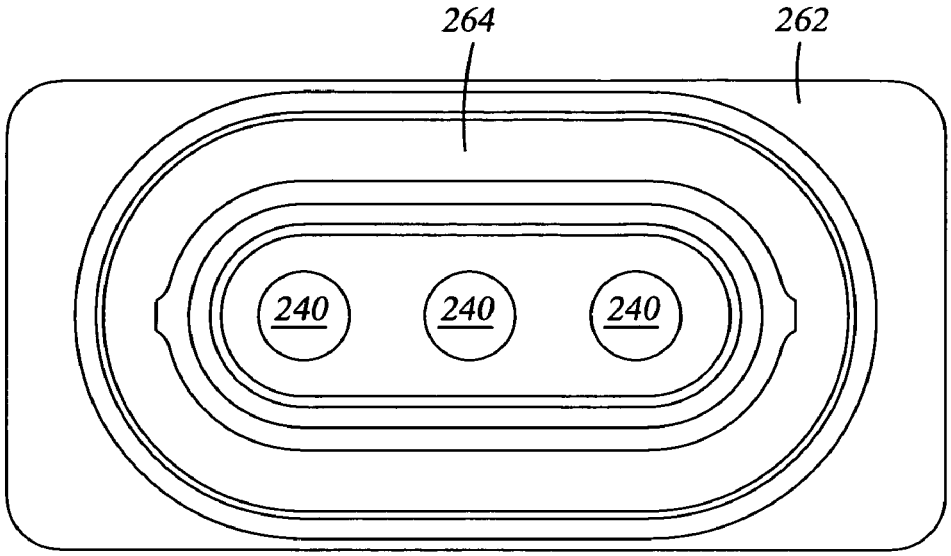
FIG. 13 shows a front view of a seal pad, in accordance with one embodiment.

FIG. 13 shows another embodiment of a seal pad similar to seal pad 260, but including an oblong or oval shape and having three ports 240.

Figure 14:
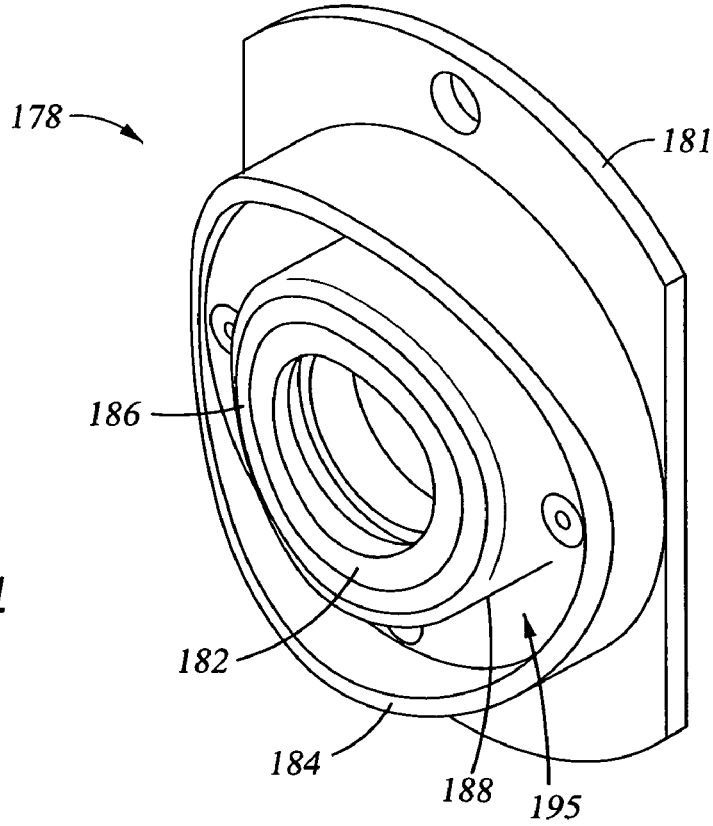
FIG. 14 is a perspective view of a seal pad, in accordance with one embodiment.
Figure 15:
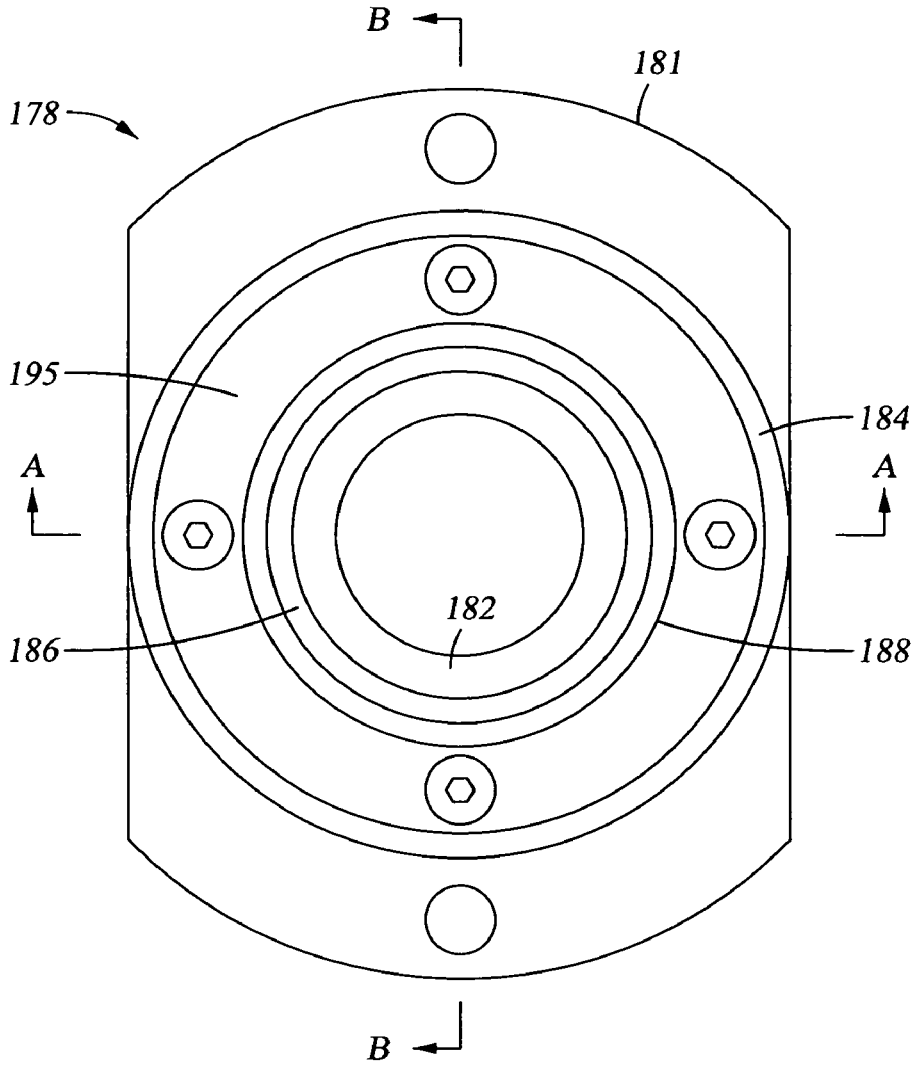
FIG. 15 is a front view of the seal pad of FIG. 14.
Figure 16:
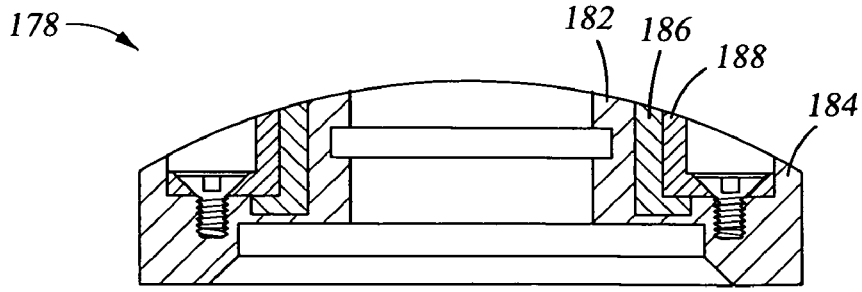
FIG. 16 is a top, section view of the seal pad of FIG. 15.
Figure 17:
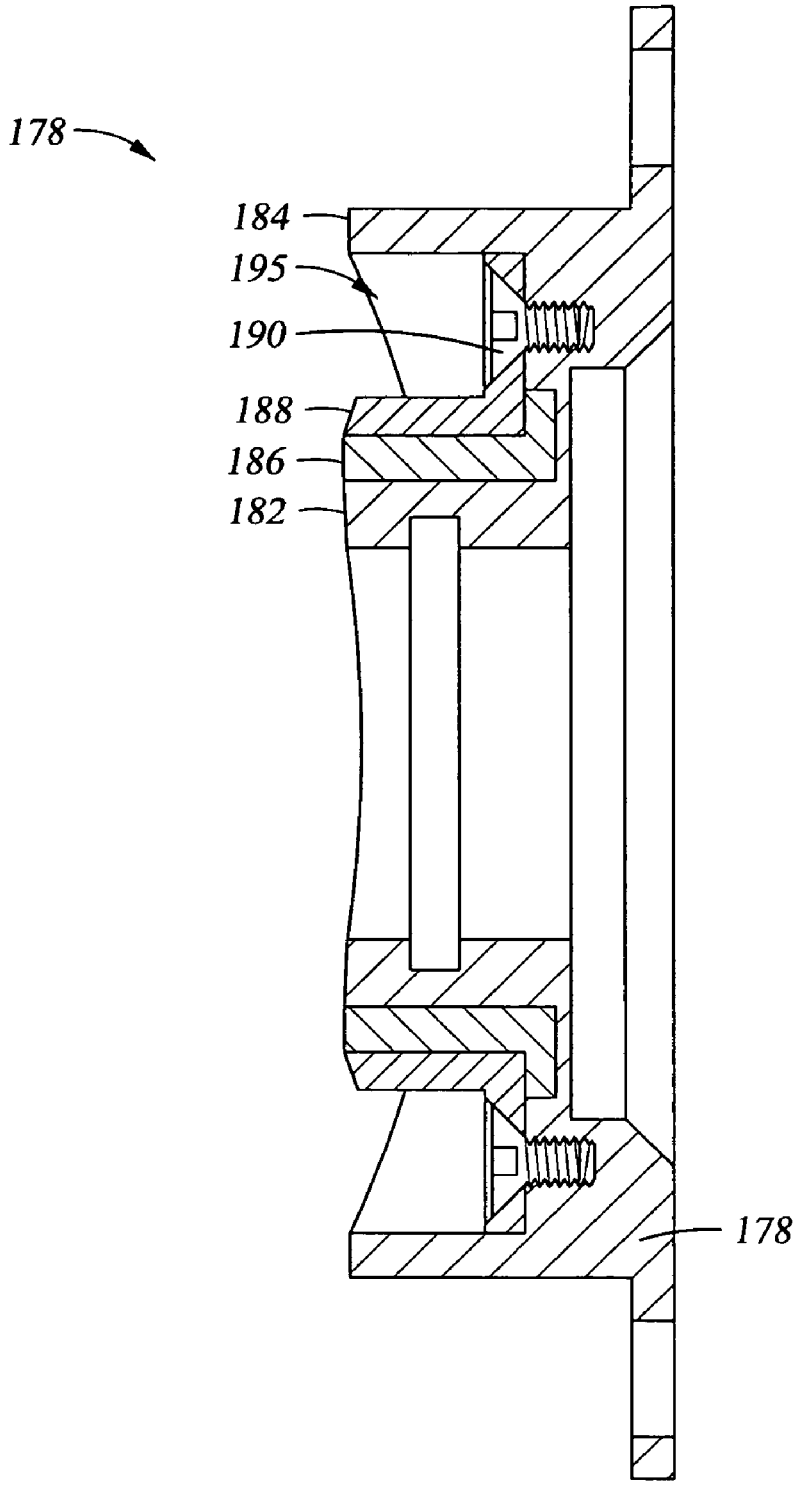
FIG. 17 is a side, section view of the seal pad of FIG. 15.

FIGS. 14-17 show further details of a seal pad 178, in accordance with one embodiment. FIG. 14 is a perspective view of seal pad 178, FIG. 15 is a front view of the seal pad 178, FIG. 16 is a top, section view of the seal pad 178, and FIG. 17 is a side, section view of the seal pad 178. Seal pad 178 is suitable to be attached to a testing tool and is represented by pad 163 in FIG. 2 or pad 180 in FIGS. 3 and 4. Seal pad 178 generally includes a base 181 with a first sealing element, such as a first inner metallic ring 182, and a second sealing element, such as a second outer metallic ring 184 extending outward from the base 181. In one embodiment, the base 181 and the first inner metallic ring 182 and the second outer metallic ring 184 are machined from a solid metallic unit, such as stainless steel. The first metallic ring 182 and the second metallic ring 184 are positioned such that there is a space 195 defined between the first metallic ring 182 and the second metallic ring 184. In one embodiment, the first inner metallic ring 182 and the second outer metallic ring 184 are substantially concentric, such that space 195 is dimensioned substantially equal all around the seal pad 178. Space 195 is configured such that when the seal pad 178 is pressed against a well bore wall, mud cake is trapped within the space 195 between first metallic ring 182 and second metallic ring 184. The mud cake then acts as an o-ring seal to help seal pad 178 provide a seal for the formation tester probe assembly probe.

In one embodiment, the seal pad 178 further includes an elastomer o-ring 186 encircling the first inner metallic ring 182. The elastomer o-ring 186 can be mounted by mounting a metal retaining member 188 over the o-ring 186 and attaching retaining member 188 using fasteners 190, such as screws. In one embodiment, o-ring 186 can be configured so as to extend slightly beyond the outer surface of inner metallic ring 182. O-ring 186 helps provide sealing against the well bore wall. In this example, the metallic outer surfaces of first metallic ring 182 and second metallic ring 184 limit the compression of o-ring 186 when the seal pad 178 is pressed against a well bore wall. This allows for more used of the seal pad 178 without having to replace o-ring 186 since compression of an elastomer o-ring at high temperatures breaks down the elastomer o-ring.

The outer surface of seal pad 178 is generally congruent to the inner surface of a cylindrical wall 112 (FIG. 2) of the borehole. Thus, the outer surfaces of inner metallic ring 182, outer metallic ring 184, and o-ring 186 can define a partial cylindrical surface. This means the pad 178 exerts generally equal pressure against the wall 112 at all parts of it surface. This provides for a better seal.

Figure 18:
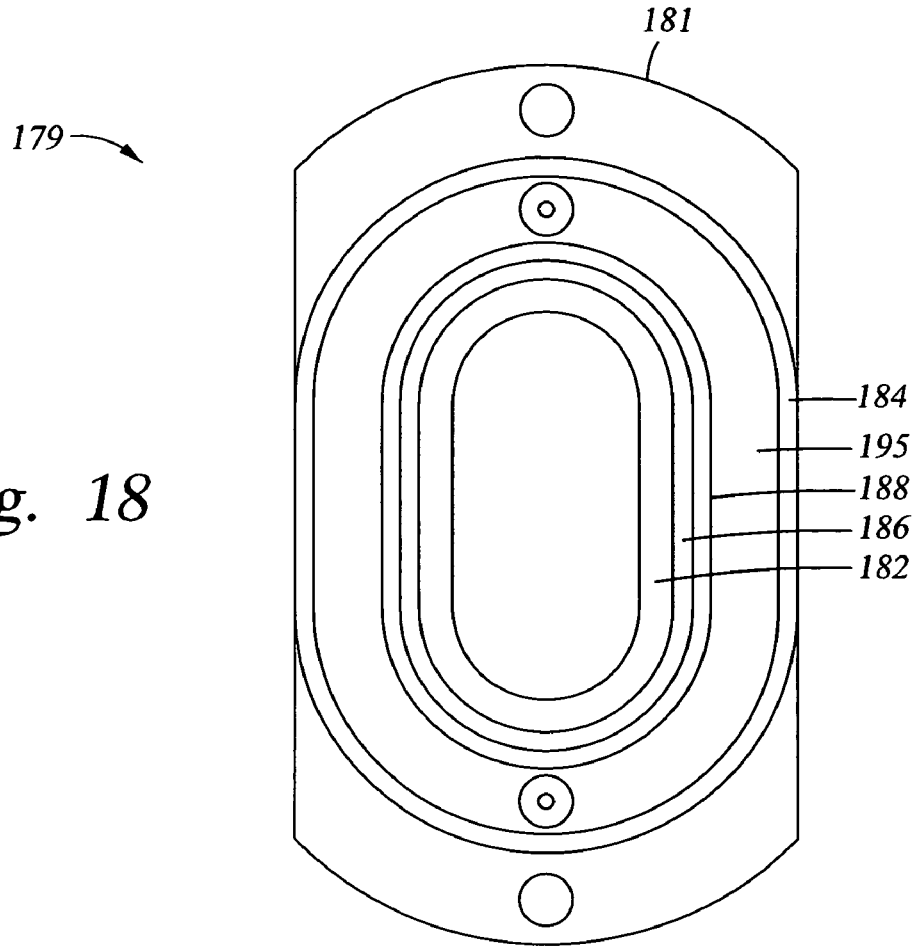
FIG. 18 shows a front view of a seal pad, in accordance with one embodiment.

FIG. 18 shows a seal pad 179 similar to seal pad 178 but having an oblong or oval shape.

Figure 19:
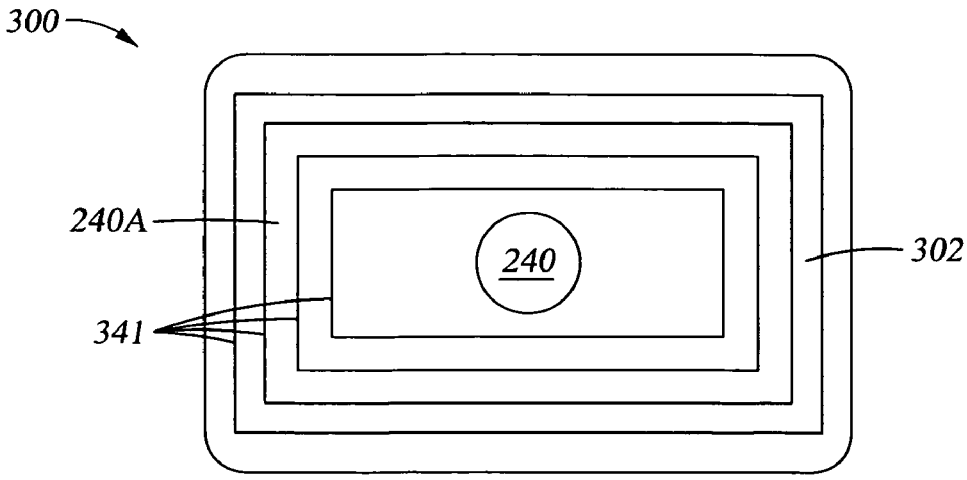
FIG. 19 shows a front view of a seal pad, in accordance with one embodiment.

FIG. 19 shows a front view of a seal pad 300, in accordance with one embodiment. In this example, seal pad 300 includes a first flow path port 240 and a second flow path port 24A. Seal pad 300 includes one or more sealing elements 341 arranged on a flexible metal pad 302 that form a seal between flow area ports 240 and 240A. In one embodiment, flow area ports 240 and 240A are directed to independent pumps as described in U.S. Pat. No. 6,301,959, entitled Focused Formation Fluid Sampling Probe, which is incorporated herein by reference. Although shown as an oval shape, in other embodiments, seal pad 300 can have any other shape, as discussed above.

Figure 20:
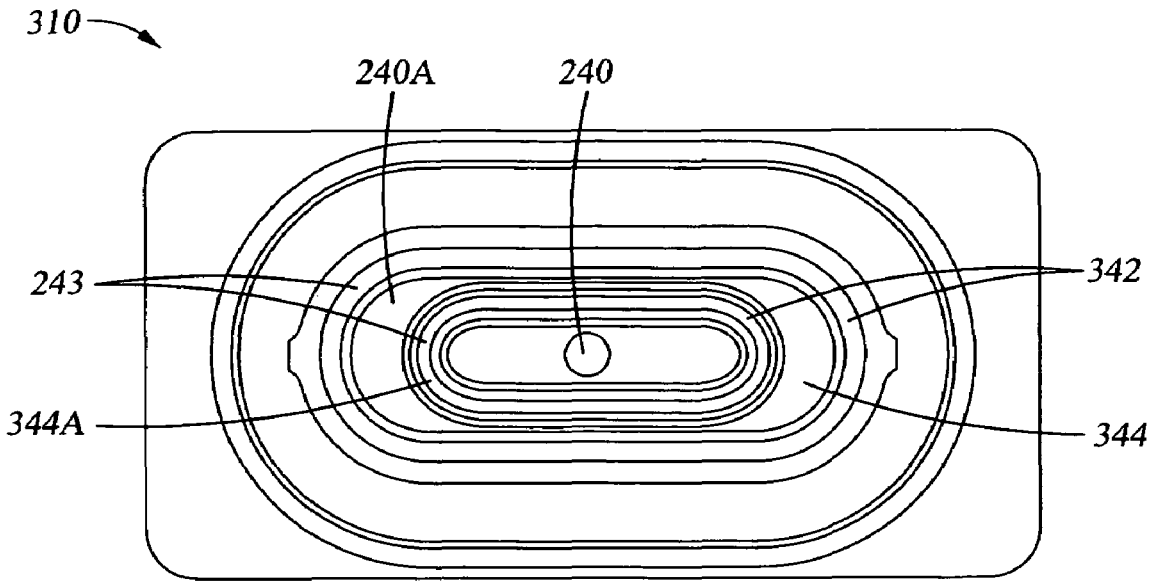
FIG. 20 shows a front view of a seal pad, in accordance with one embodiment.
Figure 21:
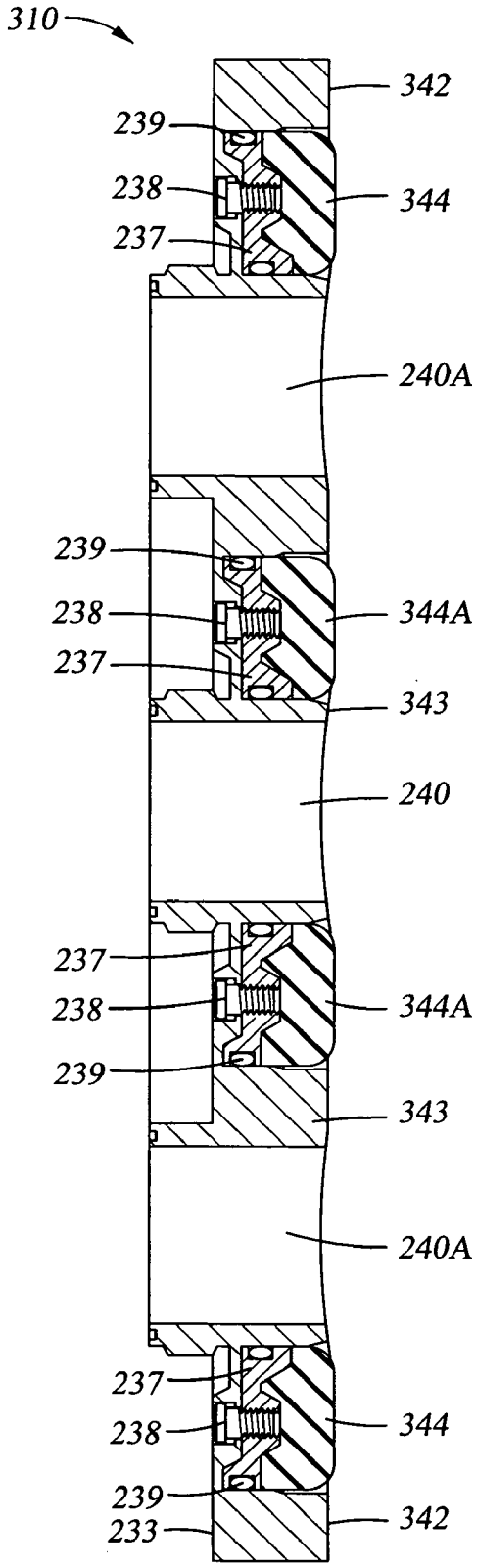
FIG. 21 shows a cross-section view of a seal pad, in accordance with one embodiment.

FIG. 20 shows a front view of a seal pad 310, in accordance with one embodiment, and FIG. 21 shows a cross-section view of seal pad 310, in accordance with one embodiment. Seal pad 310 includes one or more series of sealing elements 344 and 344A, which are contained between pad edges 342 and 343, similar to what discussed above in an earlier embodiment. Sealing elements 344 and 344A can include a movable piston 237 having at least one seal 239 between plate 233. The combination of one or more sealing elements 344 and 344A forms a seal between flow area ports 240 and 240A, which may be directed to independent pumps as described in U.S. Pat. No. 6,301,959. This embodiment shows the pad as an oval shape but the pad can be any shape that may enable forming a seal with the borehole.

Figure 22:
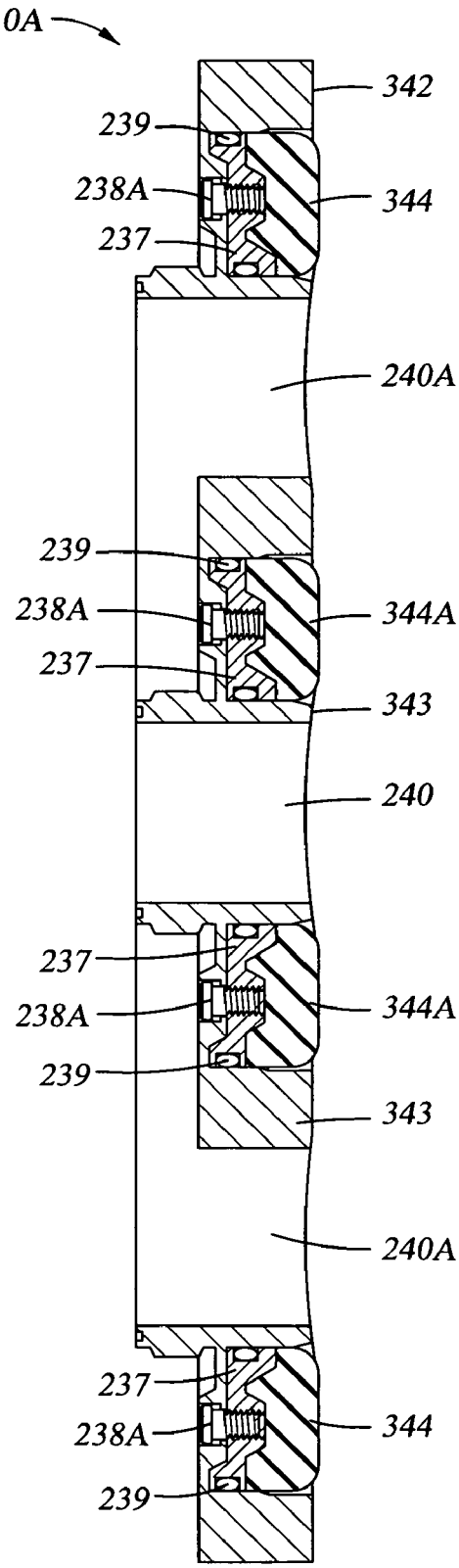
FIG. 22 shows a cross-section view of a seal pad, in accordance with one embodiment.

FIG. 22 shows a cross-section view of a seal pad 310A, in accordance with one embodiment. Seal pad 310A is similar to seal pad 310 but while seal pad 310 shown in FIG. 21 shows the back side of piston 237 exposed to the pressure of the borehole, the embodiment of FIG. 22 includes a configuration where the back of sealing element 244A is connected to flow path port 240A, and in this case the force applied to the sealing element 244A depends on the pressure difference between flow path ports 240 and 240A. The piston pad may be ported to apply force using differential pressure to sealing elements 344 by connecting the back side of piston to a flow path such as port 240 or 240A.

Figure 23:
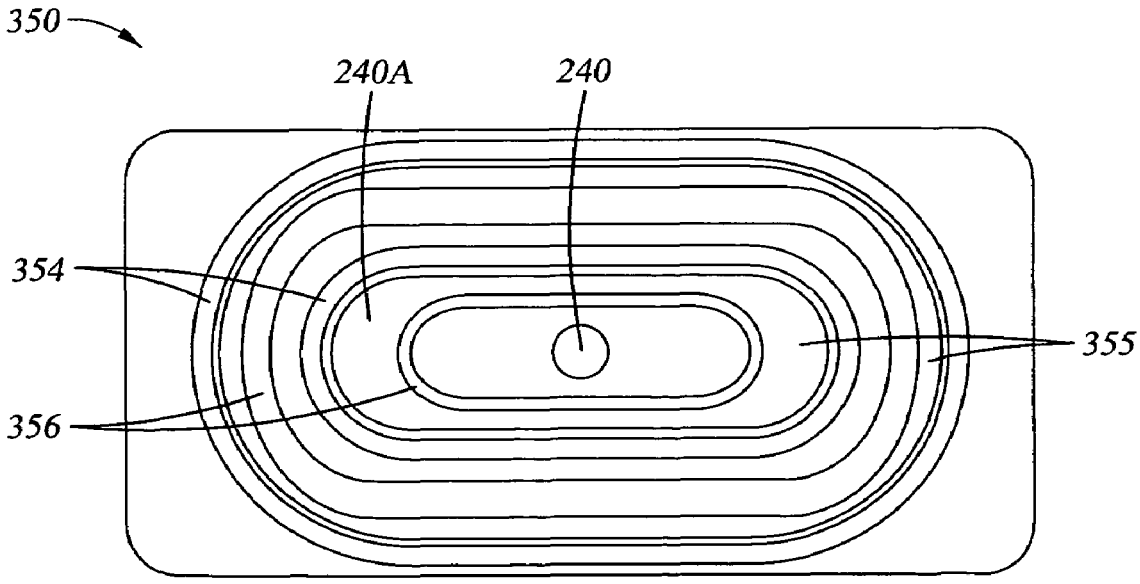
FIG. 23 shows a front view of a seal pad, in accordance with one embodiment.

FIG. 23 shows a front view of a seal pad 350, in accordance with one embodiment. Seal pad 350 includes one or more series of outer and inner sealing elements 354 and 356 forming one or more slots 355. These combinations of slots 355 form an isolation seal between flow area 240 and 240A, which may be directed to independent pumps as described in U.S. Pat. No. 6,301,959. Although this embodiment shows a pad as an oval shape the pad can be any shape that may enable forming a seal with the borehole.

Referring to FIGS. 3-4 and 14-17, the operation of formation probe assembly 50 will now be described, in accordance with one embodiment. Probe assembly 50 is normally in the retracted position (FIG. 3). Assembly 50 remains retracted when not in use, such as when the drill string is rotating while drilling if assembly 50 is used for an MWD application, or when the wireline testing tool is being lowered into the borehole if assembly 50 is used for a wireline testing application.

Upon an appropriate command to formation probe assembly 50, a force is applied to the base portion of piston 96, preferably by using hydraulic fluid. Piston 96 rises relative to the other portions of probe assembly 50. The seal pad 178 is advanced until its outer surfaces contact the mud cake 24. Mud cake 24 then enters the space 195 and helps form a seal, along with first inner metallic ring 182, second outer metallic ring 184, and o-ring 186. The highly viscous mud cake 24 is trapped between the two metallic rings 182, 184 and forms a liquid o-ring to become an effective seal against the well bore. After the seal pad 178 is set, the formation draw down procedure, or other downhole procedure, is started. Continued force from hydraulic fluid causes snorkel assembly 98 to extend such that the outer end of the snorkel extends beyond the seal pad 178 surface through seal pad aperture 186.

To retract probe assembly 50, forces, or pressure differentials, may be applied to snorkel 98 and piston 96 in opposite directions relative to the extending forces. Simultaneously, the extending forces may be reduced or ceased to aid in probe retraction.

In one embodiment, the probe assembly 50 can be a telescoping probe including a second inner piston to further extend the probe assembly. In other embodiments, formation tester tool 10 can further include fins or hydraulic stabilizers or a heave compensator located proximate formation probe assembly 50 so as to anchor the tool and dampen motion of the tool in the bore hole.

Although the discussed embodiments describe several methods that improve the ability to seal a formation for the borehole for the purpose of formation testing in hostile environments, the embodiments may be suitable to both hostile and non hostile borehole conditions.

Moreover, although the above discussion relates generally to formation tester pads used to form a seal from the borehole to the formation for pressure testing, fluid sampling and fluid analysis, the seal pads may also be used for other applications of downhole measuring where isolations mechanical, electrically or pressure is required.

The disclosures above assume a borehole with drilling fluids and mud cake. However, the disclosures are not limited to fluid filled boreholes but air-filled holes will not be discussed in the disclosures.

The above discussion is meant to be illustrative of the principles and various embodiments of the present invention. While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. A formation tester tool comprising:

a formation tester tool body having a surface;

a formation probe assembly located within the formation tester tool body, the formation probe assembly including a piston reciprocal between a retracted position and an extended position, the piston being slidingly retained within a chamber; and a seal pad located at an end of the piston, wherein the seal pad includes a first inner sealing element and a second outer sealing element, wherein there is a space between the first inner sealing element and the second outer sealing element defining an area for a mud cake material to enter such that the mud cake material functions as a sealing o-ring when the seal pad is forced against a formation wall.

2. The formation tester tool of claim 1, wherein the first inner sealing element and the second outer sealing element each have outer surfaces defining a partial cylindrical surface.

3. The formation tester tool of claim 1, wherein the first inner sealing element and the second outer sealing element are substantially concentric.

4. The formation tester tool of claim 1, wherein the first inner sealing element and the second outer sealing element are metallic members.

5. The formation tester tool of claim 1, wherein the seal pad includes a movable piston pad located between the first inner sealing element and the second outer sealing element.

6. The formation tester tool of claim 1, wherein the seal pad includes two or more ports and the seal pad is configured to form a seal between the two or more ports.

7. The formation tester tool of claim 1, wherein the seal pad includes an oval shape.

8. A formation tester tool comprising:

a formation tester tool body having a surface;

a formation probe assembly located within the formation tester tool body, the formation probe assembly including a piston reciprocal between a retracted position and an extended position, the piston being slidingly retained within a chamber; and a seal pad located at an end of the piston, wherein the seal pad includes a first inner sealing element and a second outer sealing element, wherein the seal pad includes a flexible metal pad and the first inner sealing element and second outer sealing element includes one or more raised rings on the flexible metal pad used to form a primary seal against a formation by conforming to the shape of the borehole.

9. A formation tester tool comprising:

a formation tester tool body having a surface;

a formation probe assembly located within the formation tester tool body, the formation probe assembly including a piston reciprocal between a retracted position and an extended position, the piston being slidingly retained within a chamber; and a seal pad located at an end of the piston, wherein the seal pad includes a first inner sealing element and a second outer sealing element, wherein the first inner sealing element and a second outer sealing element include raised rings on a surface of a flexible metal pad.

10. A probe assembly for a formation tester tool, the probe assembly comprising:

a piston; and a seal member located at an end of the piston, the seal member including a base, a first ring extending from the base, and a second ring extending from the base, there being a space between the first ring and the second ring, wherein the space between the first ring and the second ring defines an area for a mud cake material to enter such that the mud cake material functions as a sealing o-ring when the seal pad is forced against a formation wall.

11. The probe assembly of claim 10, wherein the first ring and the second ring each have outer surfaces defining a partial cylindrical surface.

12. The probe assembly of claim 10, wherein the first ring and the second ring are metallic members.

13. The probe assembly of claim 10, wherein the seal pad includes a movable piston pad located between the first ring and the second ring.

14. The probe assembly of claim 10, wherein the seal pad includes two or more ports and the seal pad is configured to form a seal between the two or more ports.

15. A probe assembly for a formation tester tool, the probe assembly comprising:

a piston; and a seal member located at an end of the piston, the seal member including a base, a first ring extending from the base, and a second ring extending from the base, there being a space between the first ring and the second ring, wherein the first ring and a second ring include raised rings on a surface of a flexible metal pad.

16. The probe assembly of claim 15, wherein the flexible metal pad is adapted to conform to the shape of the borehole.

17. A method comprising:

extending a piston from a formation tester tool toward a formation wall having a mudcake layer thereon;

pressing a seal pad on an end of the piston against the mudcake layer, the seal pad including a first inner ring and a second outer ring having a space therebetween; and forming a sealing o-ring between the first ring and the second ring using trapped mudcake or formation fluid to form a liquid seal, wherein the first inner ring and the second outer ring include metallic rings.

18. A method comprising:

extending a piston from a formation tester tool toward a formation wall having a mud cake layer thereon pressing a seal pad on an end of the piston against the mudcake layer, the seal pad including a first inner ring and a second outer ring having a space therebetween; and forming a sealing o-ring between the first ring and the second ring using trapped mudcake or formation fluid to form a liquid seal, wherein the first inner ring and the second outer ring include raised rings located on a surface of a flexible metal pad.

19. A method comprising:

extending a piston from a formation tester tool toward a formation wall having a mudcake layer thereon;

pressing a seal pad on an end of the piston against the mudcake layer, the seal pad including a first inner ring and a second outer ring having a space therebetween; and forming a sealing o-ring between the first ring and the second ring using trapped mudcake or formation fluid to form a liquid seal, and including a piston pad between the first inner ring and the second outer ring.

20. The method of claim 19, wherein the piston pad includes a movable piston that applies force to a sealing element relative to the differential pressure between the borehole and formation.

* * * * *

UNITED STATES PATENT AND TRADEMARK OFFICE

CERTIFICATE OF CORRECTION

PATENT NO. : 7,584,655 B2
APPLICATION NO. : 11/756241
DATED : September 8, 2009
INVENTOR(S) : Anthony H. van Zuilekom et al.

It is certified that error appears in the above-identified patent and that said Letters Patent is hereby corrected as shown below:

On the Title page, in field (75), in "Inventors", in column 1, lines 2-4, delete "Chi-Huang Michael Chang, Austin, TX (US); Sue-Lee Luo Chang, Legal Representative, Austin, TX (US);" and insert -- Chi-Huang Michael Chang, deceased, late of Austin, TX (US); by Sue-Lee Luo Chang , Legal Representative, Austin, TX (US); --, therefor.

In column 12, line 23, in Claim 17, delete "mudcake" and insert -- mud cake --, therefor.

In column 12, line 28, in Claim 18, delete "thereon" and insert -- thereon; --, therefor.

Signed and Sealed this

Fourth Day of May, 2010

David J. Kappos

David J. Kappos
*Director of the United States Patent and Trademark Office*